US011714384B2

(12) United States Patent
Lazzari et al.

(10) Patent No.: US 11,714,384 B2
(45) Date of Patent: Aug. 1, 2023

(54) STEM-CROWN OF A WATER-RESISTANT WATCH CASE, AND WATCH CASE COMPRISING SAME

(71) Applicant: Omega SA, Biel/Bienne (CH)

(72) Inventors: Nicolas Lazzari, Bienne (CH); Cédric Kaltenrieder-Ellis, Courtelary (CH)

(73) Assignee: Omega SA, Biel/Bienne (CH)

( * ) Notice: Subject to any disclaimer, the term of this patent is extended or adjusted under 35 U.S.C. 154(b) by 228 days.

(21) Appl. No.: 17/327,841

(22) Filed: May 24, 2021

(65) Prior Publication Data

US 2021/0405589 A1 Dec. 30, 2021

(30) Foreign Application Priority Data

Jun. 26, 2020 (CH) ..... 00779/20

(51) Int. Cl.
*G04B 37/10* (2006.01)
*G04B 3/04* (2006.01)
*G04B 31/00* (2006.01)

(52) U.S. Cl.
CPC ..... *G04B 37/106* (2013.01); *G04B 3/04* (2013.01); *G04B 31/00* (2013.01)

(58) Field of Classification Search
CPC ..... G04B 3/04; G04B 31/00; G04B 37/081; G04B 39/02; G04B 37/106; G04B 3/041;
(Continued)

(56) References Cited

U.S. PATENT DOCUMENTS 10,152,024 B2 * 12/2018 Baebler ..... G04B 3/041
10,613,481 B2 * 4/2020 Iguchi ..... G04B 3/041
(Continued)

FOREIGN PATENT DOCUMENTS

CN 1530776 A 9/2004
CN 101446800 A 6/2009
(Continued)

OTHER PUBLICATIONS

Combined Chinese Office Action and Search Report dated Jul. 25, 2022, in corresponding Chinese Patent Application No. 202110708430.9 (with English Translation of Category of Cited Documents), 9 pages.

*Primary Examiner* — Edwin A. Leon
(74) *Attorney, Agent, or Firm* — Oblon, McClelland, Maier & Neustadt, L.L.P.

(57) ABSTRACT

The stem-crown of a water-resistant watch case includes a tubular stem inserted into a tubular opening of a middle part of the watch case, and a crown including a first portion connected in part to the stem and a second handling portion. The first portion includes an annular contact surface inclined at less than 90° with respect to a longitudinal central axis of the stem-crown starting from the first portion towards the outside of the second portion. In a rest position, the first portion is in contact against an annular receiving surface of the middle part of complementary shape to one end of the tubular opening towards the outside. The crown further includes a washer under a bearing part of the first portion and contacting the stem, being configured to bear in an annular slot of the middle part between the tubular opening and the annular receiving surface.

16 Claims, 2 Drawing Sheets

(58) Field of Classification Search
CPC ..... G04B 37/10; G04B 37/066; G04B 3/001; G04B 3/046; G04B 3/048; G04B 27/002; G04B 27/02
See application file for complete search history.

(56) References Cited

U.S. PATENT DOCUMENTS

| | | | | |
|---|---|---|---|---|
| 11,156,962 | B2 * | 10/2021 | Kaltenrieder ..... | G04B 3/041 |
| 2003/0030230 | A1 | 2/2003 | Wild | |

FOREIGN PATENT DOCUMENTS

| | | | |
|---|---|---|---|
| CN | 109282059 | A | 1/2019 |
| CN | 209014923 | U | 6/2019 |
| DE | 1615029 | U | 10/1950 |
| JP | 52-166564 | U | 12/1977 |
| JP | 2002-40167 | A | 2/2002 |
| JP | 2007-132779 | A | 5/2007 |
| JP | 2018-151254 | A | 9/2018 |

* cited by examiner

STEM-CROWN OF A WATER-RESISTANT WATCH CASE, AND WATCH CASE COMPRISING SAME

CROSS-REFERENCE TO RELATED APPLICATION

This application claims priority to Switzerland Patent Application No. 00779/20 filed on Jun. 26, 2020, the entire disclosure of which is hereby incorporated herein by reference.

TECHNICAL FIELD

The present invention relates to a control member, such as a stem-crown of a water-resistant watch case, in particular for a diving watch.

The invention also relates to a watch case comprising a control member, such as a stem-crown for adjusting time parameters or other functions for a diving watch.

TECHNOLOGICAL BACKGROUND

To provide for the use of a mechanical or electronic watch underwater, the watch case, which comprises a horological movement or a time-based horological module, must be sealingly closed. For this purpose, the watch case comprises a back sealingly fixed to a first side of a middle part and a crystal fixed to a second opposite side of the middle part. Seals are provided for the assembly of the back, the middle part and the watch crystal. A member for controlling or adjusting the functions of the watch is also sealingly mounted through the middle part of the case in the rest position.

Generally, watch cases with the control or adjustment member are not configured or assembled to withstand high water pressures for example during a dive since the pressure inside the watch case is close to atmospheric pressure. Simple seals from traditional watches are not enough to guarantee a good water-resistance of the case when diving to very great depths underwater.

Mention may be made of patent application CH 690 870 A5 which describes a water-resistant watch case. The watch case consists of a crystal fixed on the upper side to a middle part-bezel and a back fixed to the middle part by screwing it to an internal tapping of the middle part. The crystal is fixed to the middle part by an annular O-ring shaped seal and bearing on an edge of the middle part. A seal is also provided between an outer edge of the back and a lower surface of the middle part. Since the tapping can be damaged at high water pressure, a strong metal dome is also provided to bear against an inner surface of the back and against an inner edge of the middle part. However, even with such a watch case arrangement, this does not allow to guarantee good water-resistance of the case when diving to very great depths underwater, which constitutes a disadvantage.

Patent CH 372 606 describes a water-resistant watch case, which has a central part or middle part surrounding a back and closed by a crystal. A threaded ring bears against an inclined outer surface of the back to retain it, and is screwed to a fixing part connected to the middle part. With such an arrangement presented, this does not allow to guarantee good water-resistance of the case when diving to very great depths underwater, which constitutes a disadvantage.

Patent application EP 3 432 084 A1 describes a control member, such as a stem-crown, mounted through the middle part of a watch case. The stem-crown comprises a threaded part to be screwed to a tapping of a through opening of the middle part. An upper part of the stem with a diameter larger than its threaded part bears in the rest position against a wedge in the back of a housing for receiving the upper part of the stem. An O-ring shaped seal is disposed in an annular groove in the upper part of the stem and in contact with the inner wall of the housing to ensure a water-resistance. However, such an arrangement presented does not allow to guarantee good water-resistance of the case with its control member when diving to very great depths underwater, which constitutes a disadvantage.

SUMMARY OF THE INVENTION

The main purpose of the invention is therefore to overcome the disadvantages of the prior art described above by proposing, on the one hand, a control member, such as a stem-crown of a water-resistant watch case, and on the other hand a water-resistant watch case adapted to withstand high water pressure for diving to great depths underwater.

To this end, the present invention relates to a control member, such as a stem-crown of a water-resistant watch case, which comprises the features of independent claim 1.

Particular embodiments of the control member are defined in dependent claims 2 to 12.

An advantage of the control member of a water-resistant watch case resides in the fact that it is in the shape of a stem-crown, the crown of which comprises a first portion and a second handling portion. The first portion has an annular contact surface, which is inclined at a defined angle less than 90° with respect to a longitudinal central axis of the stem-crown so as to be able to contact an annular receiving surface of the middle part, which is of complementary shape. In this way, once the stem-crown is mounted on the middle part of the watch case, any difference in water pressure compared to the pressure inside the watch case tends to close any gap between the surfaces in contact which are inclined towards the inside of the watch case.

Advantageously, the control member is in the form of a stem-crown. It comprises a bearing washer under a bearing plate or a rounded bearing part under the conical part of the first portion of the crown. The bearing washer is intended to be bearingly housed in an annular groove of the middle part in the contact position of the first conical portion of the crown and of the receiving surface of complementary shape of the middle part in a rest position. When the first conical portion of the crown contacts the receiving surface of the middle part, the bearing washer is compressed to allow it to largely occupy the annular groove in the rest position of the stem-crown and ensure a good water-resistance.

To this end, the present invention also relates to a water-resistant watch case with at least one control member, such as a stem-crown, which comprises the features of independent claim 13.

Embodiments of the water-resistant watch case are defined in dependent claims 14 to 16.

Advantageously, the crown has an annular contact surface, which is inclined at a defined angle less than 90° with respect to a longitudinal central axis of the stem-crown to contact an annular receiving surface of the middle part, which is of complementary shape in a rest position. A bearing washer of the stem-crown is also disposed in an annular slot of the middle part to ensure a good water-resistance by being compressed by a bearing part of the crown in the rest position.

BRIEF DESCRIPTION OF THE FIGURES

The purposes, advantages and features of the control member, such as a stem-crown of a water-resistant watch case and the watch case comprising same will appear better in the following description in a non-limiting manner with regard to the drawings on which.

DETAILED DESCRIPTION OF THE INVENTION

In the following description, all the components of a water-resistant watch case, in particular a diving watch, which are well known to a person skilled in the art in this technical field are only described in a simplified manner.

Figure 1:
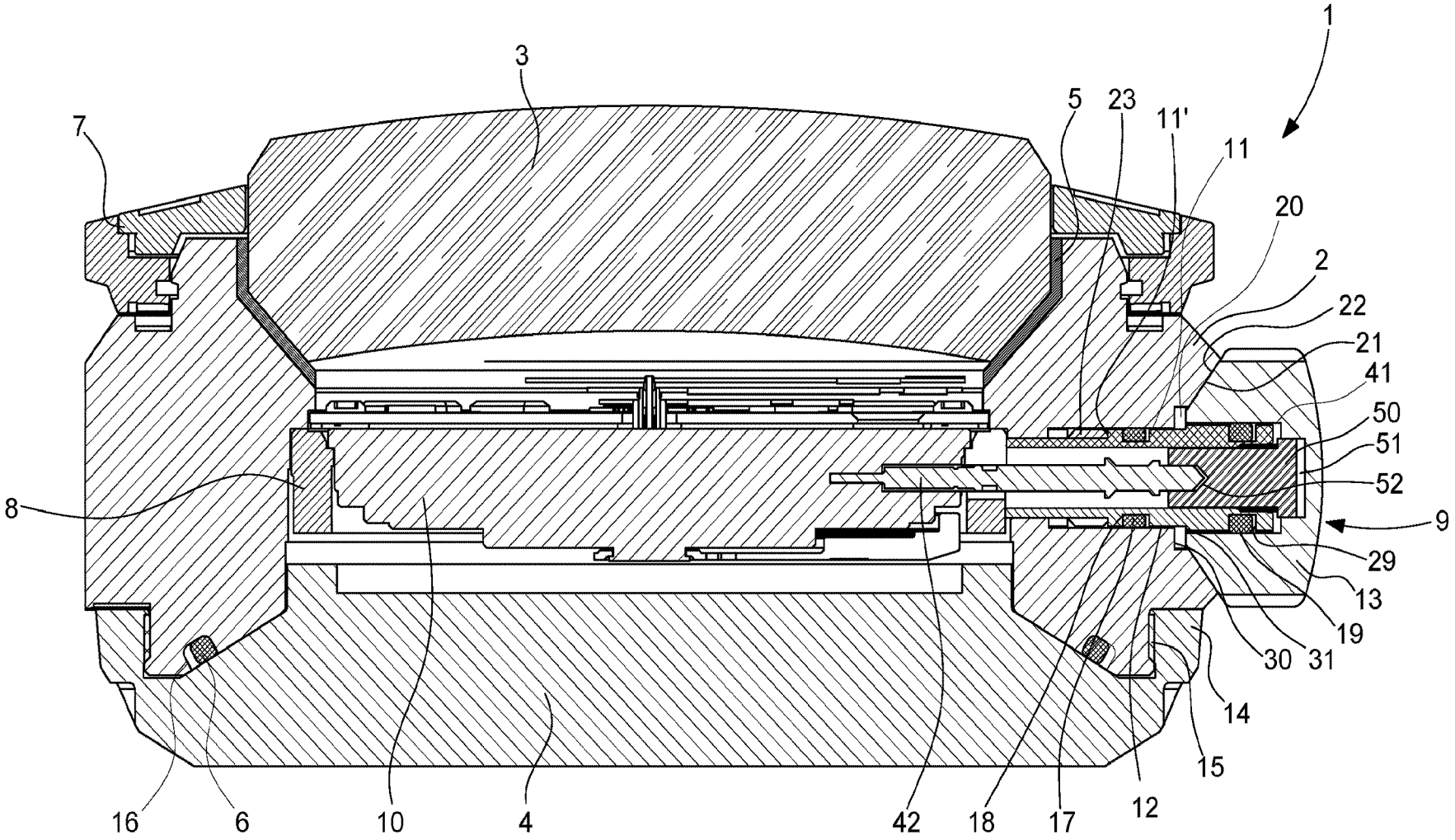
FIG. 1 shows in a simplified manner a cross section of a water-resistant case of a diving watch, which comprises a control member according to the invention.

FIG. 1 shows a watch case 1, which can be used for a diving watch. The watch case 1 essentially comprises a crystal 3, which can be made of sapphire or mineral glass, fixed on an upper side of a middle part 2, optionally a back 4 mounted on a lower side of the middle part 2, and at least one control member 9, such as a stem-crown as shown. The control member 9 can be sealingly mounted in the rest position on or through the middle part 2 or in the adjustment position as explained in more detail below with reference to FIGS. 2*a* and 2*b*. This control member 9 can be used to adjust the time, date or other functions for a diving watch. A bezel 7 can also be mounted on the upper side of the middle part 2. A horological movement or module 10 is disposed in the watch case 1 in a casing ring 8.

The control member 9 is in the form of a stem-crown 9. It mainly comprises a stem 11, which may preferably be a tubular stem, and a crown 13 capable of being manipulated by a hand of a user from the outside of the watch case 1. The crown 13 may be internally partly hollow or completely solid to be connected directly to the tubular stem 11.

Figure 2A:
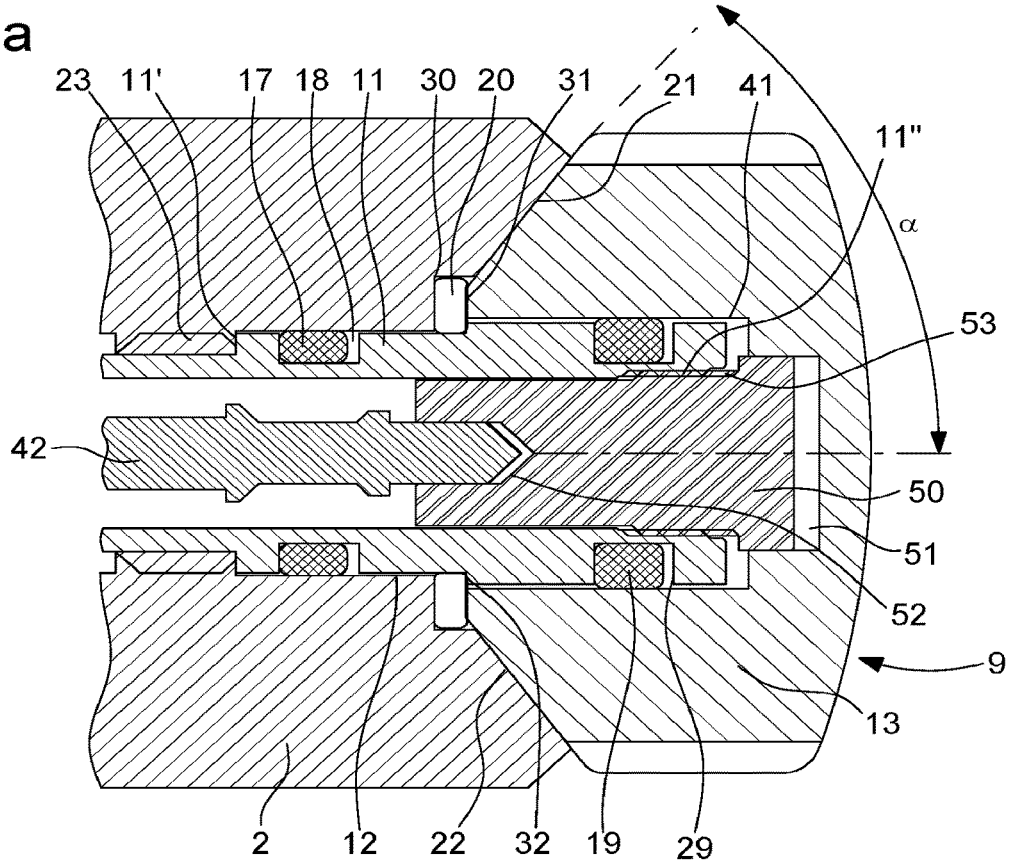
FIGS. 2*a* and 2*b* show on the one hand a detail cross section of the water-resistant case at the control member in the rest position according to the invention, and on the other hand a detail cross section of the water-resistant case at the control member in the adjustment position according to the invention.
Figure 2B:
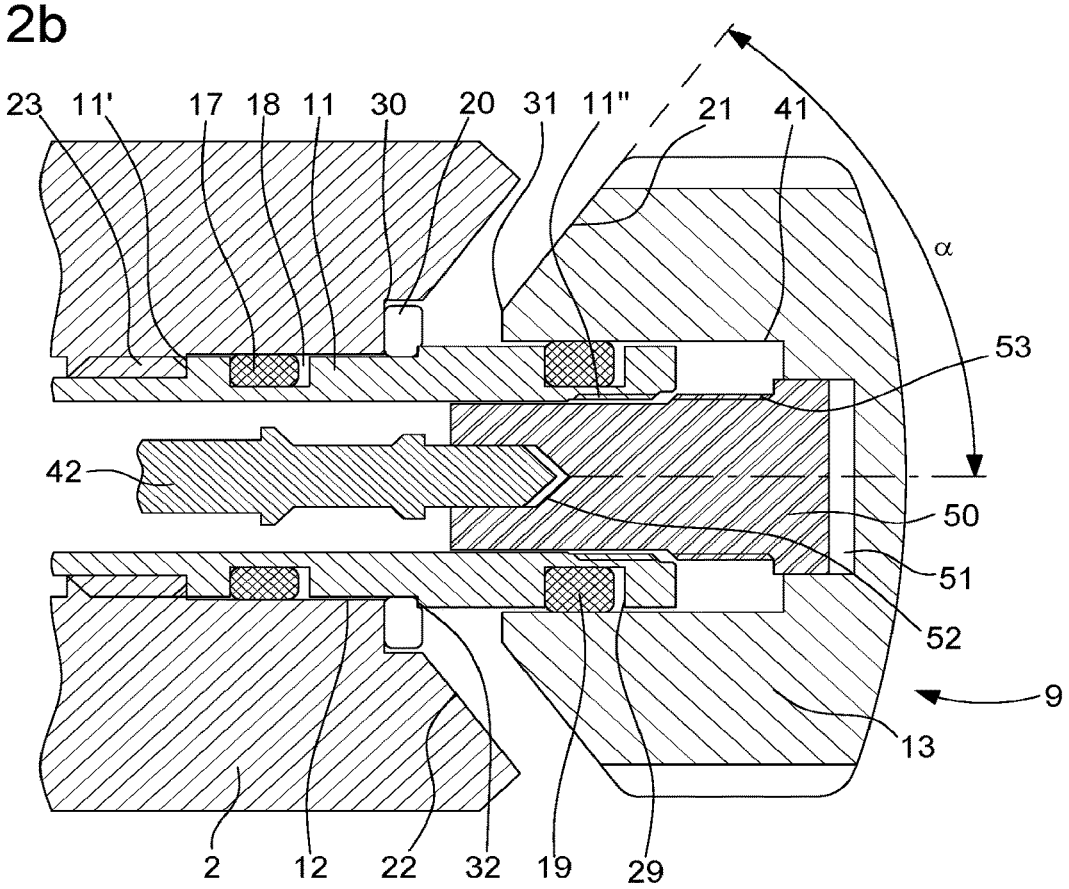

In the rest position as shown in FIG. 1, the tubular stem 11 passes through a tubular opening 12 of the middle part 2. In an alternative embodiment, the tubular stem 11 can be extended by another inner stem 42 to have access to the inside of the watch case 1 for adjusting time parameters or other functions of a diving watch. According to FIG. 1, this other inner stem 42 can be disposed in this embodiment partly inside the tubular stem 11 as shown in FIGS. 2*a* and 2*b*, to be actuated by the crown 13 connected to a piston 50 disposed inside the tubular stem 11.

The tubular stem 11 can be held by a holding means 23 in the tubular opening 12 of the middle part 2 or at its entrance in the watch case, in particular in the rest position without adjustment. Preferably, the tubular stem 11 comprises at one end towards the inside of the watch case, a threaded portion 11' to be screwed to an internal tapping 23, as a holding means, in the tubular opening 12 of the middle part 2.

The tubular stem 11 also comprises from an outer surface, a first annular slot 18 with a first O-ring shaped seal 17. This first seal 17 is in contact with the inner surface of the tubular opening 12 of diameter slightly larger than the outer diameter of the tubular stem 11. The first annular slot 18 is disposed between the threaded portion 11' and the crown 13, and preferably closer to the threaded portion 11', such that in the adjustment or unscrewing position of the tubular stem, the seal 17 remains in contact in the tubular opening 12.

The crown 13 comprises a first portion to be in contact with the middle part 2 and a second handling portion. The first portion comprises an annular contact surface 21, which is inclined at a defined angle less than 90° with respect to a longitudinal central axis of the stem-crown 9 starting from the tubular stem 11 in the direction of the second crown 13 portion.

In this embodiment of FIG. 1, an outer end of the tubular stem 11 is disposed in an internal housing 41, which is preferably an opening 41 of complementary tubular shape inside the crown 13. This tubular opening 41 is disposed along the longitudinal central axis of the crown-stem 9. The tubular stem 11 comprises on an outer surface of the outer end a second annular slot 29 housing a second O-ring shaped seal 19 (Butadiene Nitrile Rubber). The second annular slot 29 may be of rectangular cross section for holding the second seal 19. This second seal 19 is in contact with the inner surface of the tubular opening 41 of the crown 13, which has a diameter slightly larger than the outer diameter of the outer end of the tubular stem 11.

According to the present invention, the stem-crown 9 further comprises a bearing washer 20 under a bearing part 31, which may be a bearing plate 31 or a rounded bearing part under the conical part of the first portion of the crown 13. The bearing washer 20 is intended to be bearingly housed in an annular groove 30 of the middle part 2 in the contact position of the first conical portion 21 of the crown 13 and of the receiving surface 22 of complementary shape of the middle part 2 in a rest position. The thickness of this bearing washer 20 may be defined equal to or slightly greater than the height of the annular groove 30 of the middle part 2, which is opposite the bearing plate 31 or the rounded part of the first portion of the crown 13. The bearing washer 20 can be made of a flexible or elastically deformable material. Thus, when the first conical portion 21 of the crown 13 contacts the receiving surface 22 of the middle part 2, the bearing washer 20 is compressed by the bearing plate 31 or a curved part of the first portion of the crown. This allows the bearing washer 20 to occupy a large part of the annular groove 30 in the rest position of the stem-crown 9.

As can still be seen in FIG. 1 and subsequently in FIGS. 2*a* and 2*b*, the outer end of the tubular stem 11 may have a diameter substantially greater than the diameter of the tubular stem in the tubular opening 12 of the middle part 2. Thus between the outer end of the tubular stem 11 and the part of the stem 11 passing through the tubular opening 12 of the middle part 2, it is possible to define a bearing notch 32 visible in FIGS. 2*a* and 2*b* and of annular shape, which can also contact the bearing washer 20. This bearing notch 32 also allows to hold the bearing washer 20 between the first seal 17 and said bearing notch 32 before the fixing of the tubular stem 11 in the tubular opening 12 of the middle part 2. The annular bearing notch 32 is preferably disposed at the same location as the bearing part 31 of the first portion of the crown 13, when it is disposed in a rest position.

The crown 13 also comprises in its internal hollow part, a piston 50 of generally cylindrical shape, having a head fixed in a housing of complementary shape of the second portion in the shape of a cover of the crown 13. The head of the piston can be fixed by driving into said housing forming the crown cover, and can be pushed completely into said housing, which is not shown, and a fixing by laser welding can also be provided between the head of the piston and the outlet of the housing of the crown. The piston head has a diameter greater than a longitudinal part of the piston, which is introduced inside the tubular stem 11 from its outer end. The piston 50 fixed inside the crown 13 can also comprise means for holding in the tubular stem 11. Preferably, these holding means can consist, seen in FIGS. 2*a* and 2*b*, of a screw thread 53 as shown on a longitudinal part of the piston 50 and an internal tapping 11" of the outer end of the tubular stem 11 so as to screw the piston 50 connected to the crown 13. The length of the tapping can be defined between 1.5 and 2.5 mm to have a maximum stroke unscrewed from the crown in the adjustment position slightly below 2 mm. The lower part of the piston 50 further comprises a housing 52 for guiding one end of the other inner stem 42. In this case, the crown 13 with its internal piston 50 can be unscrewed and be placed in a position as shown in FIG. 2*b* for the adjustment of various functions in the watch by means of the other inner stem 42.

Of course, the means for holding the piston 50 in the tubular stem 11 can also be a simple holding by friction and/or detent so as to define a rest position of the stem-crown 9 as shown in FIG. 2*a* or an adjustment position as shown in FIG. 2*b*. However, these different possibilities will not be detailed in too much detail, since the invention resides mainly on the elements for the water-resistant closing of the crown 13 against the middle part 2 in order to ensure a good water-resistance on the diving watch. However, as shown in FIG. 2*a* in the rest position, and when the watch case undergoes significant pressure during a dive, the threaded portion 53 of the piston 50 screwed into the internal tapping 11" of the outer end of the tubular stem 11 is not subjected to any stress. The conical bearing of the surfaces 21 and 22 in contact in the rest position of the stem-crown 9 guarantees a good closing water-resistance during such a dive, and thus protects from any damage the threaded portion 53 of the piston 50 screwed into the internal tapping 11" of the tubular stem 11.

As previously indicated with reference to FIG. 1, the annular contact surface 21 of the first portion of the crown 13 is inclined at an angle defined to contact an annular receiving surface 22 of the middle part 2 in the rest position. This annular receiving surface 22 is of complementary shape to the annular contact surface 21 and normally with the same angle of inclination as the annular contact surface 21. In the case where the annular contact surface 21 of the first portion of the crown 13 is conical in shape, just like the annular receiving surface 22 of the middle part 2, the angle of inclination a of the surfaces 21, 22 can be of the order of 55°±15°, but preferably at 55°, or even at 65° or at 45°.

It should also be noted that the first portion and the second portion of the crown 13 form one single piece, for example made of a material, such as titanium, such as also for example the middle part 2. The tubular stem 11 can also be integral directly with the crown 13 to only form one single piece, if the crown 13 is solid without cavities in an embodiment not shown.

The back 4 comprises an annular edge 14 with an internal tapping to be screwed onto a tapping 15 on the lower side of the middle part 2. An annular bearing surface of the back 4 contacts an annular inner surface of the middle part 2 of complementary shape to the bearing surface when mounting the back 4 on the middle part 2. The bearing and inner surfaces are inclined at a determined angle with respect to an axis perpendicular to a watch case plane 1. In the case of a middle part of generally cylindrical shape, the bearing and inner surfaces are conical in shape and inclined towards the inside of the watch case 1 at a determined angle with respect to a central axis of the watch case 1. The lower side of the middle part 2 further comprises an annular slot 16 housing an O-ring shaped seal 6 (Butadiene Nitrile Rubber) in contact with the bearing surface when mounting the back 4 on the middle part 2. For a middle part 2 and a back 4 made of a material, such as titanium, the angle can be of the order of 60°±5° with respect to the central axis. This allows to have a good distribution of the stresses between the back 4 and the middle part 2 due to the pressure of the water when diving at great depths underwater.

The crystal 3 is fixed to the middle part 2 according to the same principle as the mounting of the back 4 to the middle part 2. For this purpose, the crystal 3 comprises an annular peripheral surface to be fixed by means of a fixing gasket 5 on an annular inner surface of the upper side of the middle part 2. The annular inner surface is of complementary shape to the annular peripheral surface. The annular peripheral surface of the crystal 3 is inclined at a defined angle less than 90° with respect to an axis perpendicular to a watch case 1 plane. Preferably, the annular inner surface is inclined generally towards the inside of the watch case 1 at the same angle as the annular peripheral surface with respect to a central axis. If the middle part 2 is generally cylindrical in shape, the annular inner surface and the annular peripheral surface are conical in shape. The defined angle of inclination of the surfaces can be of the order of 43°±5° from the central axis. This allows to have a good distribution of the stresses between the crystal 3 and the middle part 2 due to the pressure of the water when diving at great depths underwater. The difference in water pressure relative to the pressure inside the watch case 1 tends to close any gap between the surfaces in contact with the fixing gasket 5 thanks to the inclination of the contact surfaces towards the inside of the watch case 1. This guarantees a good water-resistance and resistance to high pressures.

The presented fixing gasket 5 can be made of an amorphous metal or an amorphous metal alloy. The fixing gasket 5 is of annular shape for the hermetic closing of the crystal 3 on the middle part 2. For a middle part 2 of generally cylindrical shape, the fixing gasket 5 comprises a conically shaped part surmounted by a cylindrical part attached to an annular inner wall of the middle part 2 and an annular outer wall of the crystal 3. The crystal 3 is fixed to the middle part 2 by means of the amorphous metal gasket following a hot fixing operation.

Several types of amorphous metal alloys can be used to completely make the one-piece metal gasket 5. In the most common cases, the amorphous metal alloy can be mainly composed of zirconium, which allows the gasket to be formed at a temperature higher than 350° C., that is to say above the glass transition temperature of the alloy. The amorphous zirconium metal alloy can be composed of Zr(52.5%), Cu(17.6%), Ni(14.9%), Al(10%) and Ti(5%). The amorphous zirconium metal alloy can also comprise Zr(58.5%), Cu(15.6%), Ni(12.8%), Al(10.3%) and Nb(2.8%). The amorphous metal alloy based on zirconium can also comprise Zr(44%), Ti(11%), Cu(9.8%), Ni(10.2%) and Be(25%), or finally Zr(58%), Cu(22%), Fe(8%) and Al(12%). Preferably, to facilitate the production of such a gasket, the amorphous metal alloy may be mainly composed of platinum (Pt), which allows the gasket to be formed at a temperature above 230° C. The amorphous platinum-based metal alloy can comprise Pt(57.5%), Cu(14.7%), Ni(5.3%) and P(22.5%). Provision can also be made to produce the one-piece metal gasket 5, 5' from an amorphous metal alloy based mainly on palladium (Pd), which allows to form the gasket at a temperature above 300° C.

Mention can also be made of other amorphous metal alloys. A titanium-based amorphous metal alloy can comprise Ti(41.5%), Zr(10%), Cu(35%), Pd(11%) and Sn(2.5%). An amorphous metal alloy based on palladium can comprise Pd(43%), Cu(27%), Ni(10%) and P(20%), or Pd(77%), Cu(6%) and Si(16.5%), or finally Pd(79%), Cu(6%), Si(10%) and P(5%). An amorphous nickel-based metal alloy can comprise Ni(53%), Nb(20%), Ti(10%), Zr(8%), Co(6%) and Cu(3%), or Ni(67%), Cr(6%), Fe(4%), Si(7%), C(0.25%) and B(15.75%), or finally Ni(60%), Pd(20%), P(17%) and B(3%). An iron-based amorphous metal alloy can comprise Fe(45%), Cr(20%), Mo(14%), C(15%) and B(6%), or Fe(56%), Co(7%), Ni(7%), Zr(8%), Nb(2%) and B(20%). A gold-based amorphous metal alloy can comprise Au(49%), Ag(5%), Pd(2.3%), Cu(26.9%) and Si(16.3%).

FIGS. 2*a* and 2*b* show in more detail on the one hand a cross section of the watch case at the control member 9 in the rest position in the middle part 2 (FIG. 2*a*), and on the other hand a cross section of the watch case at the control member 9 in the adjustment position, where the crown 13 is partly pulled out or unscrewed outside the opening 12 of the middle part 2 (FIG. 2*b*). For simplicity, only the elements in relation to the control member 9 and to the middle part 2 will be described, as all the elements of the watch case have already been mentioned above with reference to FIG. 1.

In this embodiment, it is considered that the annular contact surface 21 of the first portion of the crown 13 is conical in shape, as well as the annular receiving surface 22 of the middle part 2 of complementary shape to the annular contact surface 21. The bearing plate 31 or the rounded bearing part located at the back of the first conical portion of the crown 13 are provided to contact the washer 20 and in principle compress it in the slot 30 of the middle part 2 of the rest position shown in FIG. 2*a*.

In this rest position in FIG. 2*a*, the first portion of the crown 13 is placed in conical bearing in the housing with an annular receiving surface 22 of the middle part 2, once the threaded portion 11' of the tubular stem 11 has been screwed beforehand into the internal tapping 23 of the tubular opening 12 of the middle part 2. The angle of inclination a of the surfaces 21, 22 can be of the order of 55°±15°, and preferably at 55°, or even at 65° or at 45°. In this rest position, the bearing washer 20 is compressed by the bearing plate 31, and is also held by the annular notch 32 of the tubular stem 11 so as to ensure a good water-resistance in this rest position for a use of the diving watch at great depths underwater. The conical contact arrangement between the crown 13 and the middle part 2, as well as the compressed bearing washer 20, allows to hermetically close any gap between the surfaces in contact with a better distribution of the stresses.

For the adjustment of time parameters or other functions for a diving watch as shown in FIG. 2*b*, the crown 13 is pulled or unscrewed outwards while keeping the portion 11' screwed into the tapping 23 of the tubular opening 12. Normally according to an alternative embodiment, the tubular stem 11 can be connected towards the inside of the watch case by another inner stem 42 to a component for adjusting the time parameters or other functions of the diving watch. However, according to the embodiments described with reference to FIGS. 1, 2*a* and 2*b* of the present invention, the other inner stem 42 is preferably connected to the piston 50, which is fixed inside the second portion of the crown 13. In this description, the stem-crown 9 is taken as part of the watch case.

It should also be noted that it can also be considered that the cross section of the first portion of the crown 13 can be square, rectangular or polygonal. This means that the annular contact surface 21 of the crown can be constituted by several portions of inclined plane connected to each other to form the annular bearing surface. Under these conditions, the holding means 23 in the tubular opening 12 can no longer be a tapping, but a detent or hook or other holding means. The same can be done for the piston fixed inside the second portion of the crown 13.

From the description which has just been given, several variant embodiments of the control member, such as a stem-crown and of the watch case can be designed by the person skilled in the art without departing from the scope of the invention defined by the claims.

What is claimed is:

1. A control member for a stem-crown of a water-resistant watch case, the stem-crown comprising a stem intended to be inserted into a tubular opening of a middle part of the watch case, and a crown comprising a first portion connected in part to the stem and a second handling portion, wherein the first portion of the crown comprises an annular contact surface, which is inclined at a defined angle less than 90° with respect to a longitudinal central axis of the stem-crown starting from the stem connected to the first portion of the crown towards the outside of the second portion of the crown, the first portion of the crown being configured so as to be able to contact an annular receiving surface of the middle part of complementary shape, and wherein the crown further comprises a bearing washer disposed under a bearing part of the first portion of the crown and in contact with the stem being configured and intended to bear in an annular slot or groove of the middle part at the connection between the tubular opening and the annular receiving surface of the middle part.

2. The control member according to claim 1, wherein the annular contact surface is a conical surface.

3. The control member according to claim 1, wherein the angle of inclination of the annular contact surface is 55°±15°.

4. The control member according to claim 1, wherein the stem is tubular in shape to receive another adjustment stem inside the stem.

5. The control member according to claim 1, wherein the bearing part is a bearing plate or a curved part at a start of the first portion of the crown on a side opposite to the second portion of the crown, and wherein this bearing part of the first portion of the crown is arranged to compress the bearing washer in the annular slot once the stem-crown is mounted in the middle part in a rest position.

6. The control member according to claim 5, wherein the bearing part has a surface disposed substantially at 90° with respect to a longitudinal central axis of the stem-crown.

7. The control member according to claim 1, wherein the crown comprises at least one internal housing for receiving an outer end of the stem tubular in shape, and wherein the tubular stem comprises an annular bearing notch to contact the bearing washer and while being disposed at a same location as the bearing part of the first portion of the crown, when it is disposed in a rest position.

8. The control member according to claim 1, wherein an inner end of the stem comprises a threaded portion to be able to be screwed into a tapping of a tubular opening of the middle part of the watch case.

9. The control member according to claim 8, wherein between the threaded portion and the first portion of the crown in a rest position, a first annular slot is made on the stem to receive a first O-ring shaped seal.

10. The control member according to claim 1, wherein a second annular slot housing a second O-ring shaped seal is produced on an outer surface of an outer end of the stem disposed in a tubular opening in the crown, and wherein the second seal is in contact with the inner surface of the tubular opening of the crown.

11. The control member according to claim 1 wherein the crown comprises in an internal hollow part, a piston of generally cylindrical shape, having a head fixed in a housing of complementary shape of the second portion of the crown and a longitudinal part of the piston being introduced inside the tubular stem from an outer end of the stem, and wherein one end of the longitudinal part of the piston comprises a housing for guiding one end of the other inner stem.

12. The control member according to claim 11, wherein means for holding the piston in the tubular stem are provided, and wherein these holding means may comprise a screw thread on a longitudinal part of the piston and an internal tapping of the outer end of the tubular stem so as to screw the piston connected to the crown into the internal tapping of the tubular stem.

13. A watch case comprising the control member according claim 1, the watch case also comprising at least one back mounted on a lower side of the middle part, and a crystal mounted on an upper side of the middle part, wherein the middle part comprises the tubular opening through which the stein of the stem-crown passes and the annular receiving surface of the middle part at an end towards the outside of the tubular opening to receive the first portion of the crown in the rest position, and wherein the annular receiving surface of the middle part is of complementary shape to the annular contact surface, with the defined angle of inclination less than 90° with respect to the longitudinal central axis of the tubular opening towards the outside of the watch case, and wherein the crown further comprises the bearing washer disposed under the bearing part of the first portion of the crown and in contact with the stem to bear in the annular slot or groove of the middle part at the connection between the tubular opening and the annular receiving surface of the middle part.

14. The watch case according to claim 12, wherein the annular receiving surface of the middle part is conical in shape with an angle of inclination of the order of 55°±15° and equivalent to the angle of inclination of the annular contact surface.

15. The watch case according to claim 12, wherein in the rest position of the stem-crown, the first portion of the crown comprises the bearing part for compressing the bearing washer in the annular slot of the middle part.

16. The watch case according to claim 12, wherein a thickness of the bearing washer in the annular slot is identical or substantially greater than the height of this annular slot so as to be compressed by the bearing part of the first portion of the crown in a rest position of the stem-crown.

* * * * *